United States Patent [19]

Lex

[11] Patent Number: 4,574,419

[45] Date of Patent: Mar. 11, 1986

[54] DEVICE FOR TREATMENT OF SURFACES, PARTICULARLY FOR CLEANING AND POLISHING

[76] Inventor: Franz Lex, Annenstrasse 6, Graz, Austria, A-8020

[21] Appl. No.: 550,491

[22] Filed: Nov. 9, 1983

[30] Foreign Application Priority Data

Nov. 19, 1982 [AT] Austria ..... 4218/82

[51] Int. Cl.[4] ..... A47L 5/24

[52] U.S. Cl. ..... 15/328; 15/22 R; 15/344; 15/381

[58] Field of Search ..... 15/344, 380, 381, 22 R, 15/328; 51/170 MT

[56] References Cited

U.S. PATENT DOCUMENTS

| | | | |
|---|---|---|---|
| 2,270,309 | 1/1942 | Kehle | 51/170 MT |
| 2,284,671 | 6/1942 | Meinzer | 51/170 MT |
| 2,437,034 | 3/1948 | Meinzer | 51/170 MT |
| 3,972,088 | 8/1976 | Thomas | 15/22 R X |
| 4,295,240 | 10/1981 | Lex | 15/22 R |

FOREIGN PATENT DOCUMENTS

| | | | |
|---|---|---|---|
| 2025208 | 12/1971 | Fed. Rep. of Germany | 51/170 MT |

*Primary Examiner*—Chris K. Moore
*Attorney, Agent, or Firm*—Kurt Kelman

[57] ABSTRACT

The invention relates to a device for surface treatment, particularly for cleaning, polishing and grinding, and including a housing provided with a handle, which surrounds at least partly an electric motor rotating in an unbalanced manner due to a balance weight, and wherein the motor transfers its oscillating movement to a rotatable tool carrier extending transversely to the axle of the motor through a rigid connection, and wherein the oscillation system, which consists of the unbalanced drive motor and a tool carrier, is oscillatably arranged on the housing.

8 Claims, 4 Drawing Figures

DEVICE FOR TREATMENT OF SURFACES, PARTICULARLY FOR CLEANING AND POLISHING

Figure 1:
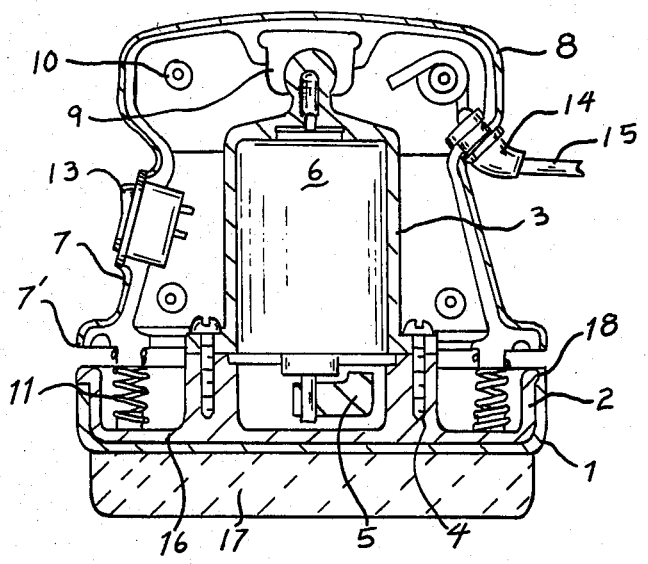

A device of the aforedescribed kind is, for example, described in U.S. Pat. No. 4,295,240 as a cleaning device. The tool carrier designated as a "cleaning element" is disposed therein on a knock-out spindle extending from the end of the housing, and wherein the cleaning tool consists of a cleaning cloth and is denoted as a "cleaning part". The knock-out spindle forms a firm component of a connection part, the so-called "drive part" in the interior of the housing, and which surrounds the balance weight in a shell-like manner, and is flanged onto the motor. The tool carrier, the so-called drive part, and the unbalanced drive motor together form the oscillating system, which is oscillatably supported on the housing.

In the above named device, certain disadvantages, particularly in the implementation of the oscillating system, could be determined. Thus, for example, the arrangement of the tool carrier on a knock-out spindle results in a larger spacing of the operating surface thereof from the elastic support, so that in the case of any non-axially directed drive-loads, a tilting moment is exerted on the elastic support, which leads to a substantial reduction of the formation of oscillations. Disadvantages also result, when a tool carrier having a larger operating surface is used, as that tool carrier must then be implemented in a very stable manner, due to a lack of any support. The known embodiment therefore requires as a whole a higher weight of the oscillating system, and consequently also a higher drive output. Furthermore, the larger construction length of the housing, due to the so-called drive part, must be viewed as a further disadvantage, as it makes the handling thereof much more difficult.

It is a task of the invention to remove these disadvantages and to further develop the above-named device, so that it ensures also a further application, apart from the above-named applications.

This is attained, according to the invention, by the drive motor being directly connected to the tool carrier, which in turn is oscillatably arranged on the housing substantially by means of oscillation elements disposed in its peripheral region and extending parallel to the axle of the motor, and wherein the tool carrier which adjoins the rim of the housing therebelow and at a small spacing therefrom, includes approximately at the level of the balance weight and in the rim region connecting surfaces or connecting elements for replaceable attachment of operating means or additional devices, and wherein the tool carrier is closed off directly below the balance weight by means of a floor plate which is optionally insertable or may be set up, and which under certain circumstances is also suitable as support for the operating means. Treatment tools or operating means of different types can therefore be advantageously disposed near the balance weight, and also on the housing, so that also in case of tools having a larger operating surface, a frequently required edge use of the device, for example in the treatment of hollow channels, edges or the like is possible at a full effect of the oscillating system. Since consequently also greater connecting surfaces have been created on the tool carrier, an easily replaceable and reliably holdable attachment is ensured not only of operating means, but also of any additional devices for further use of the apparatus.

In the further development of the invention, it is possible to provide that the oscillatable holder consists of an elastic suspension, for example of several swing bolts distributed uniformly along the periphery, extending parallel to the axle of the motor, and disposed between the rim of the housing and the tool carrier. These can then provide for the tool carrier to be secured to the unbalanced drive motor at a distance from the end of the housing which is required for the oscillating movement, and therefore also offer advantageously an adequate securement against any twisting thereof, or of the entire drive system.

Inventive advantages according to a further development of the invention can also be obtained thereby, if additionally to the oscillatable holder, the oscillating system is supported, or optionally held in a pivot support on a side of the housing disposed opposite to the oscillatable holder. The oscillatable holder can therefore transfer the oscillating movement without being loaded by any possibly higher operating pressure forces, so that a pendulum-like, circular-like oscillating movement may thereby be transferred.

It is also an advantage if the tool carrier is formed as a pan open on a side facing the oscillating side of the motor, and whose mantle preferably extends along a circumference equal to that of the housing, as consequently within the rim region thereof a connecting surface is formed, which considerably facilitates the attachment of treatment tools or operating means, for example of a cleaning cloth.

Particular advantages of an inventive nature can also be obtained, if the tool carrier includes a projection which is spaced downwardly from the tool carrier in an annular manner, and which is provded with connecting surfaces, or preferably with attachment means of a bayonet type, the shaft of the motor with the balance weight extending into that projection directly up to the upper surface of a floor plate, which in turn may optionally be inserted or set up, or extending up to a holder for the operating means. By this means, different operating means suitable for surface treatment can be replaceably and also holdably inserted without any effort on the housing, so that the device can be quickly matched to the respective application.

In a further implementation of the invention, it can also be provided that the tool carrier, and optionally also the housing is formed with air passages, and by there being provided a dust catching aggregate instead of the floor plate, which is attachable to the ring-shaped projection, and which substantially consists of a dust filter and a container for the caught dust, inclusive of a handle, and by the balance weight being removeably disposed in favor of the insertion of a suction rotor. By attaching a suction rotor instead of a balance weight, the drive motor can no longer exert an oscillating drive movement. Upon insertion of the dust catching aggregate onto the annular projection of the tool carrier, instead of the floor plate insertable thereonto, the drive motor is also connected through that projection with the container for the caught dust, and wherein the housing at least partly surrounding the drive motor is now moveable along the oscillatable motor support, but does not thereby exert any effect whatever.

A further development of the invention consists therein that a cover part is associated with a blower motor, which in turn remains constantly on the shaft of the motor, the cover part, in the case of a requirement (for oscillating treatment of the surfaces) being in turn settable onto the blower motor, closing off at least the suction openings of the blower motor, and including the balance weight. By this means, the suction effect of the suction rotor is inhibited during polishing operations or the like, and only a part, namely the cover plate including the balance weight, is to be arranged on the suction rotor or on the shaft of the drive motor, in the case of a requirement.

An optimal effect of the device can be attained for both different uses according to a further advantageous implementation of the invention, by there being provided regulating means for the number of rotations, such as, for example a voltage regulator for the current supply, for driving of the balance weight at a number of rotations, which is smaller than that of the blower rotor.

Figure 2:
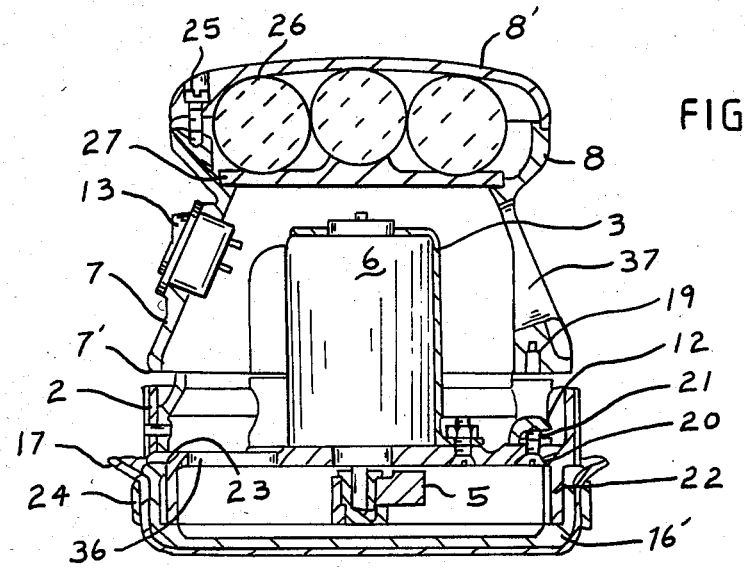
Figure 4:
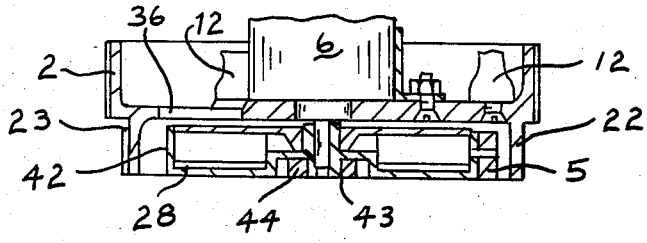
Figure 3:
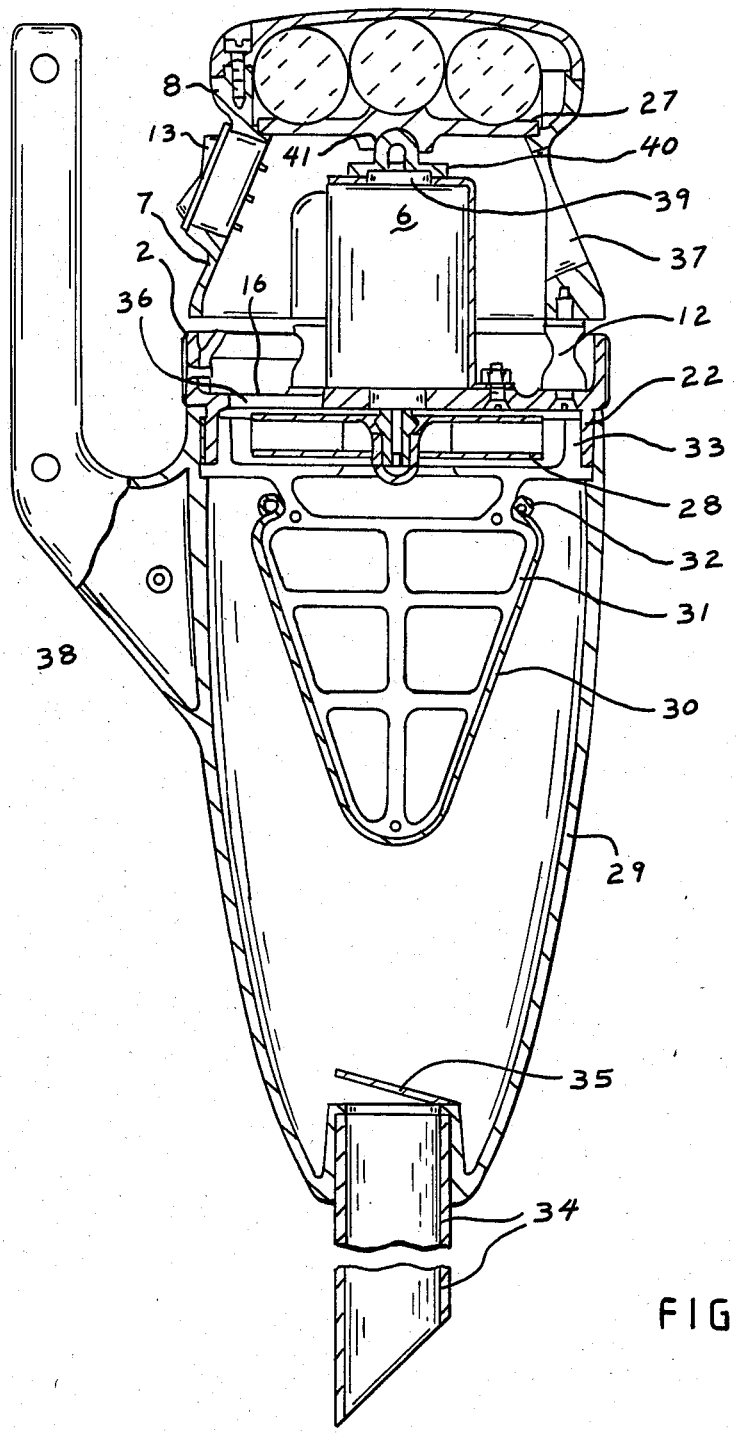

For clarity's sake, the invention is further illustrated with the aid of two implementation examples: there are shown in FIG. 1 a longitudinal section of the inventive device, in FIG. 2 a longitudinal section through a further device according to the invention, in FIG. 3 a longitudinal section of the device, according to FIG. 2, but transformed into a vacuum cleaner, and in FIG. 4 a partial section of a variant of FIGS. 2 and 3.

In the inventively implemented device of FIG. 1 for cleaning, polishing and grinding, the tool carrier 2 receiving the treatment tool 1 is connected by means of a double-armed bracket 3 and by means of screws 4 directly to the drive motor 6, so as to be oscillatable therewith, which motor rotates in an unbalanced manner due to a balance weight 5, the tool carrier 2 being supported in a pendulum-like manner through a ball-and-socket joint 9, which is a ball-shaped extension of the bracket 3, and which is disposed in a housing 7, namely at the end of the holder 8. The housing 7 and the ball-and-socket joint 9 inserted therein are partitioned for this purpose in the cutting plane into two parts, and wherein the housing-and support-halves may be threadably bolted by means of four screws, - represented by the symmetry lines 10.

The tool carrier 2 ends adjoining to the balance weight 5 with a pan-shaped floor plate 16, and is supported through the joint 9 so in the housing 7, that the tool carrier 2 is spaced with the upper rim of the floor plate 16 from the rim 7' of the housing disposed opposite to the holder 8 of the housing. The spacing between the rim 7' of the housing and the upper border of the floor plate 16 amounts to about 3 to 6 millimeters. The named parts, which are disposed so as to oscillate with the unbalanced drive motor 6, and which together form the oscillating system, are oscillatably held and supported at about the level of the balance weight 5 through four helical springs 11 disposed in the direction of the axle of the drive motor 6, and arranged at the same peripheral distance between the rim 7' of the housing and the floor plate 16. On the housing 7 there are further arranged the starting and stopping switch 13, as well as the rubber lip 14 for the current cable 15. The treatment tool 1 is also pot-shaped, and is connected with a foam part 17, which serves for polishing. It is secured through its own tension and through claw-like extensions, which engage recesses 18 of the tool carrier 2.

In FIG. 2, the tool carrier 2 is connected to a suspension 12 connected to the rim 7' of the housing, serving as an oscillatable holder, and therefore spaced from the rim 7' of the housing at a distance permitting an oscillatory movement, and is simultaneously supported on the rim 7' of the housing. The elastic suspension 12 consists of three swing bolts uniformly distributed on the outer periphery on the housing and disposed parallel to the longitudinal axle of the drive motor 6, which on one side are screwed into the rim 7' of the housing through built-in vulcanized threaded pins 19, and include on the other side built-in vulcanized nuts 21, through which the tool carrier 2 is secured to the rim of the housing 7' by means of flat headed screws 20. The tool carrier 2 includes a ring-shaped extension 22, into which projects the shaft of the drive motor with the balance weight 5 and wherein an insertable floor plate 16' with a bayonet lock 23 is disposed thereon. Since the insertable floor plate 16' is also pan-shaped, cleaning cloths 17 can be disposed thereon by means of the tension ring 24, or operating means can be used, which are provided with foam materials, grinding leaves or the like, so as to also effect polishing and grinding.

The housing 7 is manufactured in one piece with one part of the bulge-shaped handle 8, and wherein the further part 8' of the handle is screwed thereonto by means of screws 25. In the partitioned handle 8, 8' there are disposed several rechargeable batteries 26 for driving the motor 6. The batteries 26 are disposed on a supporting plate 27 inserted in the holder 8. In the housing 7 there are also disposed the start-stop switch 13, as well as a connector socket for charging of the batteries 26, which, however, is not visible in this representation.

FIG. 3 shows the device according to FIG. 2 alternately with parts disposed thereon serving to suck off dust, and wherein instead of the balance weight 5 there is disposed on the ring-shaped projection 22 of the tool carrier 2 the suction rotor 28, and instead of the insertable floor plate 16' there is disposed on that ring-shaped projection 22 the dust catcher aggregate consisting of the container 29 for the caught dust and of the dust filter 30, 31. The housing 7 and the tool carrier 2 are formed with passage openings 36, 37, which are also of advantage when using the device for polishing or the like, as these effect a good aeration of the drive motor 6. At the end of the container 29 for the caught dust the suction nozzle 34 is insertable, which in turn is closable by the non-return valve 35. The dust filter 30 is secured by means of the elastic ring 32 to the cage 31, which in turn is partitioned into two parts in the plane of the section. Handling of the apparatus transformed in a further development into a device for suctioning off dust is accomplished by the handle 38 disposed on the container 29 for the caught dust.

The oscillating system 2, 5, 6, which, according to FIGS. 2 and 3, is oscillatably supported on the elastic suspension 12, can additionally also be slidably or pivotably supported on the side of the housing 7, 8 opposite to the elastic suspension, as shown in FIG. 1. An implementation version of the additional pivot support is shown in FIG. 3, and consists of a supporting portion 40 disposed on the bearing extension 39 of the drive motor 6, and being semi-spherically shaped on the end thereof, the supporting portion 40 being guidably received in a recess 41 formed in the support plate 27. It is obvious that in the case of use of any additional abutment or support, that abutment or support remains constantly disposed there, both during polishing, as well as during suctioning off dust.

In FIG. 4, which shows the tool carrier 2, a portion of the drive motor 6, and of the elastic suspension 12 in cross-section, the suction rotor 28 remains always, secured to the shaft of the drive motor 6, namely also during polishing or the like. In the case of transformation of the device to polishing or the like, the suctioning effect of the blower rotor 28 is made inoperative by the cover part 42. The arrangement of the cover part 42, on the outer side of which the balance weight 5 is secured, is accomplished, for example, by means of the nut 4, which may be screwed onto a threaded sleeve 43 formed on the blower rotor 28. When the device is transformed for suctioning off dust, only the cover portion 42 is therefore to be removed, and the dust catching aggregate is to be inserted on the ring-shaped extension 22. It is also an advantage, if there is provided on the device or exterior thereof an arrangement for regulating the number of revolutions, such as for example a voltage regulator of the current supply, for driving of the balance weight 5, and having a number of revolutions smaller than those of the blower rotor 28, as a voltage regulator is of particular advantage compared to a possible mechanically-acting regulation of the number of revolutions.

The versions shown in the individual figures and described therein can also be exchanged with respect to one another. In particular, the suspension 12 formed as a pivotable holder, and the additional support 40, 41, or the additional holder 9 can be used in all versions. Any devices disposed between the drive motor 6 and the tool carrier 2, which do not immediately serve for transmitting oscillations, such as, for example an annex rigidly connected therewith, have hereby no influence on the inventive operating effect.

The insertable treatment tools can be shaped differently, or can be disposed by means of an extension on the tool carrier 2. It is also possible to optionally form the device instead of with the handle 8, with an extension rod, or to form the housing thereof in such a manner, that an extension rod can be disposed thereon, so that the device can also serve as a floor device.

I claim:

1. A surface treatment device comprising (a) a housing defining an air passage opening and having an axis, a closed end and an open end opposite to the closed end, (1) a peripheral rim defining the open end of the housing, (b) an electric motor extending through the open end into, and at least partly surrounded by, the housing, the electric motor having (1) a rotatable axle coaxial with the housing axis, (c) a coaxially arranged tool carrier defining an air passage opening adjacent the open housing end, the tool carrier being slightly spaced from the peripheral housing rim and extending transversely to he housing axis, (d) means rigidly connecting the tool carrier to the housing of the electric motor, (e) oscillation elements disposed along the peripheral housing rim and extending parallel to the housing axis and the motor axle, the oscillation elements connecting the tool carrier to the housing for oscillatory movement in relation thereto, and (f) a surface treatment attachment replaceably mounted on the tool carrier.

2. The surface treatment device of claim 1, further comprising an eccentric weight mounted on the motor axle for imparting an oscillatory movement to the rotating motor, the connecting means transmitting the oscillatory motor movement to the tool carrier, the surface treatment attachment being replaceably mounted on the tool carrier substantially at the level of the eccentric weight and the eccentric weight being accessible upon detachment of the surface treatment attachment.

3. The surface treatment device of claim 2, wherein the tool carrier comprises a pan-shaped element having a peripheral rim facing the housing rim.

4. The surface treatment device of claim 3, wherein the oscillation elements comprise a plurality of oscillatable bolts uniformly distributed about the peripheral rims and elastically suspending the tool carrier on the housing.

5. The surface treatment device of claim 4, wherein the tool carrier further comprises an annular skirt coaxially surrounding the motor axle and the eccentric weight mounted thereon, the surface treatment attachment comprises a bottom element mounted on the skirt and enclosing the eccentric weight, and further comprising means for replaceably mounting the bottom element on the skirt.

6. The surface treatment device of claim 2, further comprising a pivot support pivotally mounting the electric motor and the tool carrier rigidly connected thereto on the closed end of the housing.

7. The surface treatment device of claim 2, wherein the tool carrier is a pan-shaped element having a peripheral rim facing the housing rim, the oscillation elements comprise a plurality of oscillatable bolts uniformly distributed about the peripheral rims and elastically suspending the tool carrier on the housing, the tool carrier comprises an annular skirt coaxially surrounding the motor axle, and further comprising a blower rotor mounted on the motor axle and coaxially surrounded by the skirt, the blower rotor defining suction openings, a cover part detachably mounted on the blower rotor for closing off the suction openings thereof, and said eccentric weight being affixed to the cover part.

8. The surface treatment device of claim 2, wherein the tool carrier is a pan-shaped element having a peripheral rim facing the housing rim, the oscillation elements comprise a plurality of oscillatable bolts uniformly distributed about the peripheral rims and elastically suspending the tool carrier on the housing, the tool carrier comprises an annular skirt coaxially surrounding the motor axle, and further comprising a suction rotor replaceably mounted on the motor axle and coaxially surrounded by the skirt, and a dust catching unit detachably mounted on the annular skirt, the dust catching unit including a dust container in communication with the suction rotor, a dust filter housed on the container and a handle attached to the container, the housing and the tool carrier defining air passages in communication with the suction rotor, and said surface treating attachment comprises a suction nozzle mounted on said dust container.

* * * * *